US007910048B2

(12) United States Patent
Jurewicz et al.

(10) Patent No.: US 7,910,048 B2
(45) Date of Patent: Mar. 22, 2011

(54) APPARATUS FOR PLASMA SYNTHESIS OF RHENIUM NANO AND MICRO POWDERS

(75) Inventors: Jerzy W. Jurewicz, Sherbrooke (CA); Jiayin Guo, Sherbrooke (CA)

(73) Assignee: Tekna Plasma Systems Inc., Sherbrooke, Quebec ( * ) Notice: Subject to any disclaimer, the term of this patent is extended or adjusted under 35 U.S.C. 154(b) by 0 days.

(21) Appl. No.: 12/349,486

(22) Filed: Jan. 6, 2009

(65) Prior Publication Data

US 2009/0243168 A1 Oct. 1, 2009

Related U.S. Application Data

(62) Division of application No. 11/041,870, filed on Jan. 25, 2005, now Pat. No. 7,494,527.

(60) Provisional application No. 60/538,459, filed on Jan. 26, 2004.

(51) Int. Cl.
*B22F 9/20* (2006.01)

(52) U.S. Cl. ..... 266/192; 219/121.49

(58) Field of Classification Search ..... 75/346; 219/121.49

See application file for complete search history.

(56) References Cited

U.S. PATENT DOCUMENTS

| | | | | |
|---|---|---|---|---|
| 3,475,158 | A | 10/1969 | Neuenschwander | |
| 5,200,595 | A * | 4/1993 | Boulos et al. | 219/121.52 |
| 5,369,241 | A * | 11/1994 | Taylor et al. | 219/121.49 |
| 6,379,419 | B1 * | 4/2002 | Celik et al. | 75/346 |
| 6,398,125 | B1 * | 6/2002 | Liu et al. | 239/13 |
| 6,551,377 | B1 | 4/2003 | Leonhardt | |

FOREIGN PATENT DOCUMENTS

RU 2048279 C1 11/1995

OTHER PUBLICATIONS

Tribalat S. Rhénium et technetium, Gauthier-Villars, Paris, 1957.
Davenport, William H. et al., "Rhenium Chemicals—Their Properties and Applications," Cleveland Refractory Metals (Division, Chase Brass & Copper Co.), 1969.
Jungfleisch, M.L., et al., "Monographies sur les Métaux De Haute Pureté," Masson et Cie, Éditeurs, 1972.

* cited by examiner

*Primary Examiner* — George Wyszomierski
(74) *Attorney, Agent, or Firm* — Robert Kinberg; Lars H. Genieser; Venable LLP

(57) ABSTRACT

The process for the synthesis of rhenium powders comprises the injection of ammonium perrhenate powder through a carrier gas in a plasma torch of a plasma reactor operated using a mixture including hydrogen as the plasma gas, yielding metallic rhenium under the following chemical reaction:

$$2NH_4ReO_4+4H_2 \rightarrow 2Re+N_2\uparrow+8H_2O\uparrow.$$

The reactor is provided with a quench zone for cooling the metallic rhenium so as to yield rhenium nano and micro powders.

19 Claims, 3 Drawing Sheets

APPARATUS FOR PLASMA SYNTHESIS OF RHENIUM NANO AND MICRO POWDERS

CROSS-REFERENCE TO RELATED APPLICATION

This application is a divisional of application Ser. No. 11/041,870, filed Jan. 25, 2005, now U.S. Pat. No. 7,494,527, and which claims the benefit of U.S. Provisional Application No. 60/538,459, filed Jan. 26, 2004, all of which is are incorporated by reference herein in their entirety.

FIELD OF THE INVENTION

The present invention relates to rhenium synthesis. More specifically, the present invention is concerned with a process and apparatus for plasma synthesis of rhenium nano and micro powders, and for coating and near net shape deposits thereof.

BACKGROUND OF THE INVENTION

A conventional process for the production of metallic rhenium powders is described in both 1) Tribalat S. Rhénium et technétium, Gauthier-Villars, Paris, 1957, and in 2) Davenport W. H., Spelman J. W., Vaeth H. J. Rhenium Chemicals, Cleveland Refractory Metals, 1969. This conventional process is based on the hydrogen reduction of ammonium perrhenate according to the following reaction:

$$2NH_4ReO_4+7H_2 \rightarrow 2Re+2NH_3\uparrow+8H_2O\uparrow \quad (1)$$

This reaction is carried out in two consecutive steps; the first involving the thermal decomposition of ammonium perrhenate at 300° C. into gaseous ammonia and rhenium oxide (IV);

$$NH_4ReO_4+3/2H_2 \rightarrow ReO_2+NH_3\uparrow+2H_2O\uparrow. \quad (2)$$

The second step involves the reduction of the formed rhenium oxide, at 1000° C., to produce metallic rhenium according to the following reaction:

$$ReO_2+2H_2 \rightarrow Re+2H_2O\uparrow \quad (3)$$

A drawback of this conventional process is that it is relatively slow, and has to be interrupted after 2 hours, in the event that the product is required in powder form. In this case, the formed sintered porous metal oxide/metallic intermediate product has to be ground to the required particle size, followed by the further hydrogen reduction of the powder for a few more hours.

Other processes of bulk rhenium production from the prior art include electrolyse, thermal decomposition of rhenium carbonyl or rhenium tri-chloride, or reduction of rhenium hexa-fluoride. These processes from the prior art are described in Chaudron G., Dimitrov O. Monographies sur les métaux de haute pureté, Chapitre 10 Rhénium, p. 235-242, MASSON, Paris, 1972.

Drawbacks from these other processes from the prior art include:

- the yielding of sponge like products difficult to handle and requiring post treatment processing, and
- toxicity of the by-products (environmentally hostile).

OBJECTS OF THE INVENTION

An object of the present invention is therefore to provide improved process and apparatus for synthesis of rhenium nano and micro powders.

Another object of the present invention is to provide improved process and apparatus for coatings and near net shape deposits of rhenium nano and micro powders.

SUMMARY OF THE INVENTION

More specifically, in accordance with a first aspect of the present invention, there is provided a process for the synthesis of rhenium powders comprising: injecting ammonium perrhenate powder through a carrier gas in a plasma torch of a plasma reactor operated using a mixture including hydrogen as the plasma gas, yielding metallic rhenium under the following chemical reaction: $2NH_4ReO_4+4H_2 \rightarrow 2Re+N_2\uparrow+8H_2O\uparrow$; and quenching the metallic rhenium, yielding rhenium powders.

According to a second aspect of the present invention, there is provided an apparatus for the synthesis of rhenium powders from ammonium perrhenate, comprising: a plasma torch including a plasma chamber, a reactant feeder for injecting ammonium perrhenate powder in the plasma chamber through a carrier gas including hydrogen; and a reaction chamber mounted to the plasma torch downstream therefrom so as to be in fluid communication with the plasma torch for receiving metallic rhenium from the plasma torch; the reaction chamber being provided with quench means for rapidly cooling the metallic rhenium, yielding rhenium powders.

The process and apparatus according to the present invention allows for the plasma synthesis of rhenium nano and micro powders through high reaction rate due to high temperature of the plasma and the fact that the reduced substance ($Re_2O_7$) is in the vapour state (the overall reaction is in the gaseous phase). The reaction conditions ease the formation of sub-micron and nano-sized metallic products.

Forming metallic rhenium powder according to a process from the present invention involves a single step, is simple, and can easily be integrated into a continuous process.

A process for plasma synthesis of nano and micro powders according to the present invention involves the thermal decomposition of ammonia, which forms atomic hydrogen, and such in statu nascendi formed, very reactive atomic hydrogen reduces easily the remaining rhenium oxide.

The decomposition of the ammonia to elemental nitrogen and hydrogen lowers the overall consumption of gaseous hydrogen to 2 moles of $H_2$ per mole of ammonium perrhenate as to compare to 3.5 moles of $H_2$ per mole of the ammonium perrhenate in the conventional process, which amount to almost 43% savings in hydrogen consumption. The remaining nitrogen is environmentally friendly.

The process for plasma synthesis of rhenium nano and micro powders according to the present invention yields very pure rhenium products which are limited only by the purity of the raw materials used, since high frequency electrode-less plasma discharges are known not to introduce external sources of reaction product contamination. The process may be carried out for the synthesis of rhenium powders, or for the deposits of rhenium as coatings or near net shaped part. In the latter case, all the reduction steps are accomplished during the in-flight treatment period prior to the formation of the rhenium deposit through successive impacts of the formed rhenium molten droplets on the substrate placed underneath the plasma plume.

Other objects, advantages and features of the present invention will become more apparent upon reading the following non restrictive description of preferred embodiments thereof, given by way of example only with reference to the accompanying drawings.

DETAILED DESCRIPTION

Figure 1:
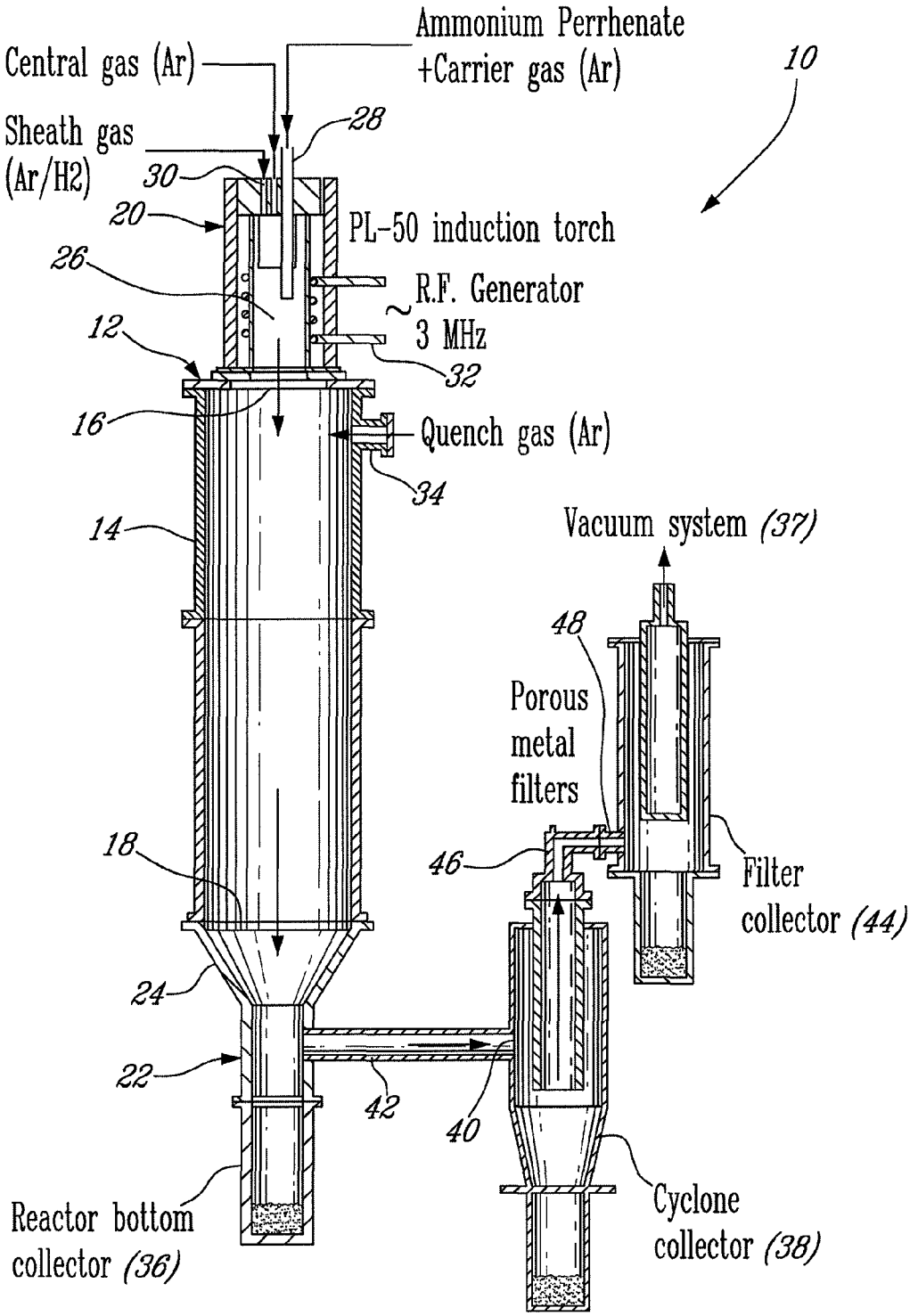
FIG. 1 is a cross-section of an apparatus for plasma synthesis of rhenium powder according to an illustrative embodiment of a first aspect of the present invention.

An apparatus 10 for plasma synthesis of rhenium nano and micro powders according to an illustrative embodiment of the present invention will now be described with reference to FIG. 1.

The apparatus 10 comprises a plasma reactor 12, including a generally cylindrical reaction chamber 14 having opposite top and bottom longitudinal end apertures 16-18, a plasma torch 20 mounted on top of the reaction chamber 14 so as to be in fluid communication therewith through said top end aperture 16, and a first collector in the form of a reactor bottom collector 22 mounted to the reaction chamber 14 through the bottom end aperture 18 via a funnel 24 so as to be in fluid communication therewith and downstream thereof.

The plasma torch 20 is in the form of a an induction plasma torch model PL-50 from Tekna Plasma Inc. and includes a generally cylindrical plasma chamber 26, a reactant feeder 28 for injecting ammonium perrhenate powder in the plasma chamber 26 through a carrier gas, and an input aperture 30 for feeding the plasma chamber 26 with sheath gas. Another stream of gas—so called central gas is fed tangentially into plasma chamber through separate input. The induction plasma torch 20 is powered by a radio frequency generator 32, which is a 3 MHz generator in the case of the PL-50 model.

Of course the plasma torch may be of another type and have another configuration than the illustrated plasma torch 20.

The reaction chamber 14 is in the form of a water-cooled stainless steel chamber, which may be of any form providing enough time to the reaction to occur. The reaction chamber 14 is provided with quench means 34 for rapidly cooling reaction products coming from the plasma torch 20.

According to the illustrated embodiment of FIG. 1, the quench means 34 is in the form of a quench gas feeder integral to the reaction chamber 14 and located adjacent the plasma torch 20, where the distance is controlled by the time required to complete the desired reaction and vary with processing parameters. For given processing parameters this distance was 120 mm.

The quench means 34 may also be in the form of a cold finger realized by inserting a water-cooled cylindrical/flat surface insert against plasma jet providing rapid cooling of the off gas, or the cold solid surface in the form of particulate matters in the form of fluid bed or an evaporating liquid injected through fine spraying nozzle thus forming either flat or hollow cone mist barrier against which the plasma gas has to go through.

Typical dimensions for the reaction chamber 14 are as follows:

length: 1.4 m;

diameter: 0.26 m; and diameter of the top longitudinal end aperture 16: 0.05 m.

The first collector 22 comprises a receptacle 36 connected to the funnel 24 so as to be in fluid communication therewith and configured and mounted to the reactor chamber 14 so as to allow collection of rhenium powder by gravity, following the thrust of the plasma jet and/or or by suction as provided by the vacuum system 37 located downstream from the first collector. As will become more apparent upon reading the following description, the vacuum 37 is coupled with the reactor bottom collector 22 so as to be in fluid communication therewith.

The apparatus 10 further comprises second collector 38 in the form of a cyclone collector having its inlet 40 connected to the reactor bottom collector 22 via a conduit 42 so as to be in fluid communication therewith and so as to be located downstream therefrom.

The apparatus 10 may also comprise a third powder collector 44 in the form of a filter collector, including porous metal filters, having its inlet 48 connected to the outlet 46 of the cyclone collector 38.

Since cyclone and filter collectors and vacuum systems are believed to be well known in the art and for concision purposes they will not be described herein in more detail.

Of course, other configurations of reactor collectors may also be provided allowing collecting rhenium powder produced in the plasma reactor 12.

A process for plasma synthesis of rhenium nano and micro powders will now be described according to an illustrative embodiment of a second aspect of the present invention.

The single step process is based on the flash heating, decomposition and reduction of ammonium perrhenate. The chemical reactions involved can be represented by the following transformations;

$$2NH_4ReO_4 \rightarrow Re_2O_7 + 2NH_3\uparrow + H_2O\uparrow \quad (4)$$

$$2NH_3 \rightarrow N_2 + 3H_2 \quad (5)$$

$$Re_2O_7 \rightarrow 2Re + 7/2O_2\uparrow \quad (6)$$

$$Re_2O_7 + 7H_2 \rightarrow 2Re + 7H_2O\uparrow \quad (7)$$

where the in statu nascendi formed rhenium oxide vapour (the sublimation point of $Re_2O_7$ is 200° C.) is instantaneously reduced by the in statu nascendi formed, very reactive hydrogen released through the reaction of decomposition of the ammonia. This reaction may be catalytically enhanced by the metallic rhenium coming from possible thermal decomposition of $Re_2O_7$ to metallic rhenium and oxygen at 800° C. The supplementary hydrogen required for the completion of the reduction process according to equation 7 is supplied from a plasma gas mixture of Ar and $H_2$.

Alternatively to the above-described chemical route, another chemical route for the formation of metallic rhenium according to the illustrative embodiment of the second aspect of the present invention is provided including the thermal decomposition of ammonium perrhenate to $Re_2O_7$, followed by the subsequent thermal decomposition of the formed $Re_2O_7$ to metallic rhenium and oxygen at 800° C., according to reactions 4 and 6 respectively.

According to this second route, the liberated free oxygen, is then consumed by the strongly exothermic combustion of ammonia and free hydrogen which forms part of the plasma gas according to equations 8 and 9:

$$2NH_3+3/2O_2 \rightarrow N_2+3H_2O-H_r=-633kJ/mol \quad (8)$$

$$2H_2+O_2 \rightarrow 2H_2O \quad (9)$$

The overall reaction, independent of the reaction route, could then be represented by the following chemical transformation:

$$2NH_4ReO_4+4H_2 \rightarrow 2Re+N_2\uparrow+8H_2O\uparrow \quad (10)$$

Experimental Results

Rhenium metal in the form of an ultrafine powder was synthesized using the process and apparatus for plasma synthesis of rhenium nano and micro powders according to the present invention. More specifically, the plasma decomposition/reduction of ammonium perrhenate powder has been achieved using an inductively coupled radio frequency (rf) plasma reactor. The apparatus used is as illustrated in FIG. 1 and is composed of an induction plasma torch model PL-50 by Tekna Plasma Inc. placed on the top of a water-cooled stainless steel chamber.

The ammonium perrhenate powder was axially injected into the center of the plasma torch 20 using argon as the carrier gas. The plasma torch was operated at near atmospheric pressure using an argon/hydrogen mixture as the plasma gas consisting of 10% volume of hydrogen. The ammonium perrhenate feed rate was varied in the range of 7.5-14.3 g/min for a plasma plate power of 60 to 65 kW.

As the individual ammonium perrhenate powder particles come in contact with the plasma gas, they are heated rapidly, evaporated and dissociated as per the chemical transformations (10) above. The reaction is completed in the plume of the plasma flow with the reaction products, mixed with the plasma gases, enters the quench section of the reactor 12. At this point the reaction products are cooled rapidly through their mixture with the quench gas which can be either Argon or recycled Argon/Hydrogen mixture. The cooling of the reaction products gives rise to the homogeneous condensation of the rhenium metal in the form of an ultrafine aerosol with particle size in the nanometer to micron range depending on the cooling rate to which the reaction products were exposed. The formed rhenium powder is collected either on the cold walls of the main reaction chamber, in a downstream cyclone or in a sintered metal filter. It is common practice to expect different properties and particle size distributions of the powder collected at the different location of the reactor and powder collection system Products collected from different locations were analyzed and characterized separately.

The powders collected from the reactor walls, reactor bottom and cyclone were micrometric in size formed of agglomerates of much finer particles (80 nm<dp<260 nm). Those collected in the filter (20-30% weight of the total recovered) were nanometric (30 nm<dp<60 nm).

Figure 2A:
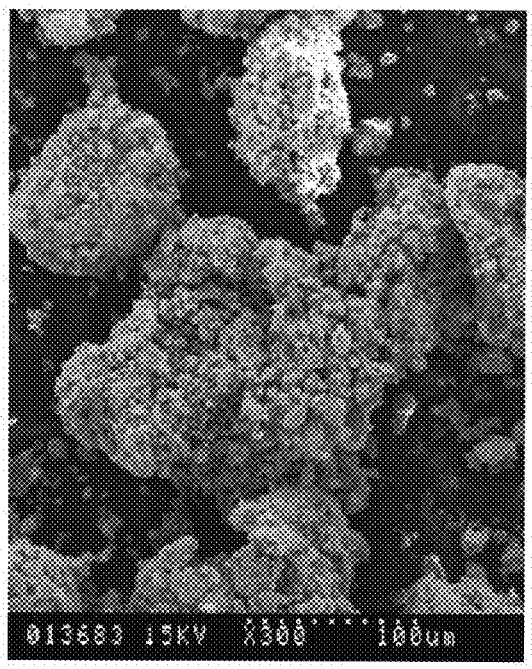
FIGS. 2A-2B are electron micrographs of the rhenium powders obtained at the reactor bottom and filter of the apparatus from FIG. 1 following experiments performed using a process for plasma synthesis of rhenium nano and micro powder from the present invention.
Figure 2B:
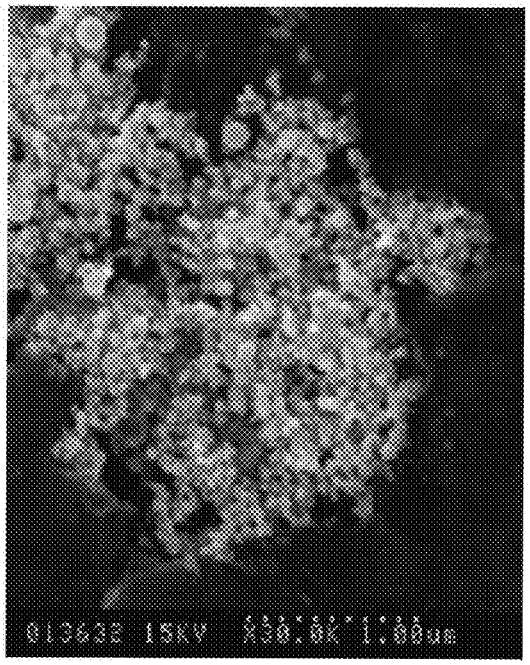
Figure 3:
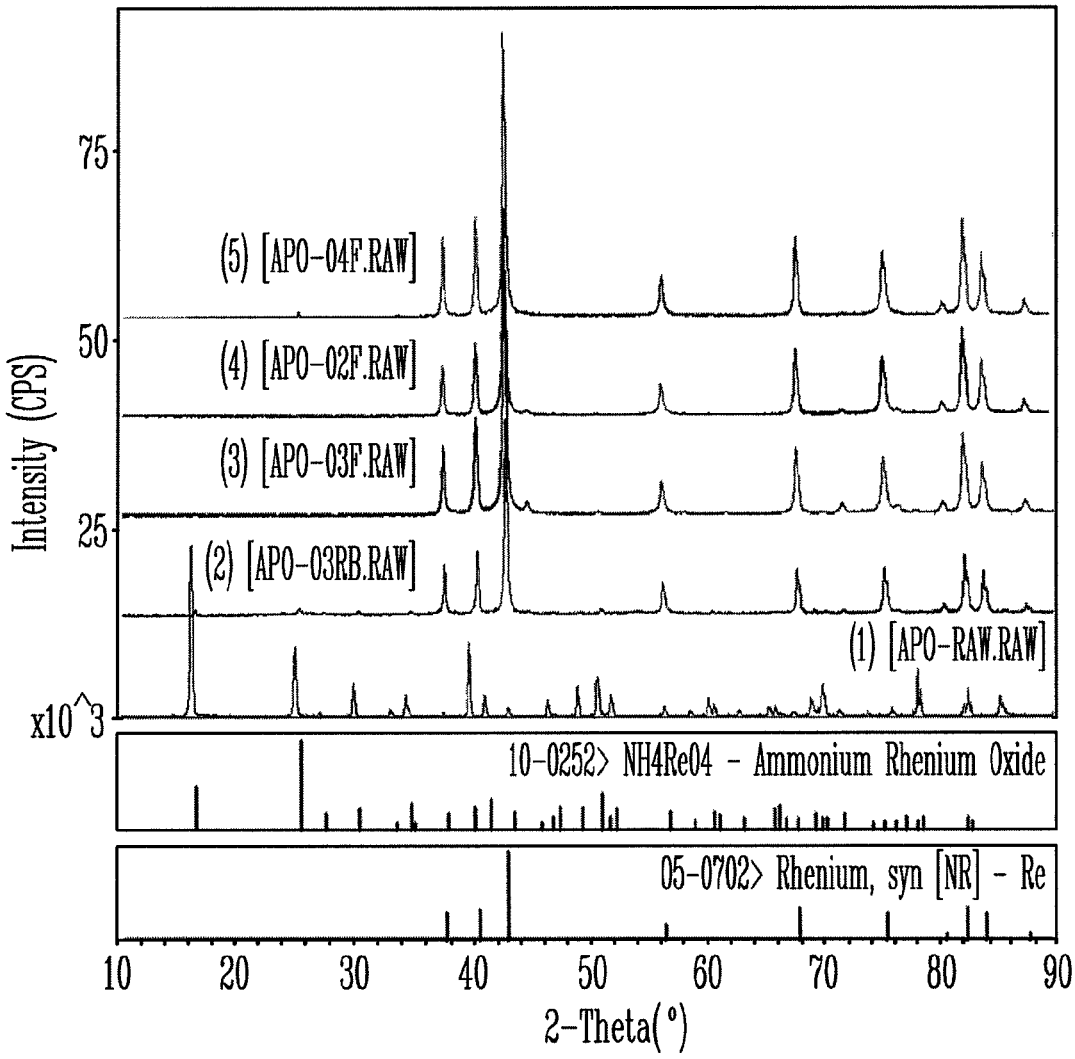
FIG. 3 is are X-Ray diffraction graphs of the rhenium powders obtained at the reactor bottom and filter of the apparatus from FIG. 1 following the experiments mentioned with reference to FIGS. 2A-2B.

Typical electron micrographs of the rhenium powders obtained at the reactor bottom and filter are shown in FIGS. 2A-2B. The range of particle sizes of the powder was confirmed by a measurement of its specific surface area in $m^2/g$ using an adsorption isotherm (Brunauer, Emmet, Teller—BET) method. The overall conversion was near 100% based on X-Ray Diffraction (XRD) analysis of the resulting products, as shown in FIG. 3, which did not show any presence of residual ammonium perrhenate. The purity of the product was confirmed through residual oxygen analysis (performed using a LECO model RO500C device) which showed values less than 1000 ppm of residual oxygen in the collected rhenium powders.

In the event that the formed rhenium particles are impacted on the surface of a substrate before completely solidifying, they would spread on that surface forming tiny lamella that are the building blocks of a fine grained coating and/or near net shaped deposit. In the latter case, the process is continued until the required part dimensions are reached followed by the removal of the substrate using mechanical or chemical means such as respectively machining and etching. The reaction chamber to be used in this case would be similar to the reaction chamber illustrated in FIG. 1 with the addition of an access port on the upper end 16 of the reactor 12 through which the substrate is introduced at a relatively short distance from the nozzle exit of the plasma torch 20. Typical spraying distances used in this case can be in the range of fifteen (15) to twenty five (25) centimeters. The position of the quench gas injection is determined so as to allow the condensation of the reaction product in the form of molten rhenium droplets without freezing them, in-flight, which would prevent their deposition on the substrate surface.

Although the present invention has been described hereinabove by way of preferred embodiments thereof, it can be modified without departing from the spirit and nature of the subject invention, as defined in the appended claims.

What is claimed is:

1. An apparatus for the synthesis of rhenium powders from ammonium perrhenate, comprising:

a plasma torch including a plasma chamber, a reactant feeder for injecting ammonium perrhenate powder in said plasma chamber through a carrier gas including hydrogen; and a reaction chamber mounted to said plasma torch downstream therefrom so as to be in fluid communication with said plasma torch for receiving metallic rhenium from said plasma torch; and a quench feeder mounted in fluid communication with said reaction chamber and adjacent to said plasma torch and selected from the group consisting of a quench gas feeder for feeding a quench gas into said reaction chamber and a fine spraying nozzle for injecting an evaporating liquid into said reaction chamber.

2. An apparatus as recited in claim 1, wherein said quench feeder comprises said quench gas feeder for feeding said quench gas into said reaction chamber.

3. An apparatus as recited in claim 2, wherein said quench gas feeder is integral to said reaction chamber.

4. An apparatus as recited in claim 1, wherein said quench feeder comprises a cold finger inserted within said reaction chamber so as to intersect a plasma gas from said plasma torch.

5. An apparatus as recited in claim 4, wherein said cold finger includes a cooled surface.

6. An apparatus as recited in claim 5, wherein said cold finger comprises a high heat capacity liquid cooled cylindrical or flat surface.

7. An apparatus as recited in claim 6, wherein said high heat capacity liquid includes water.

8. An apparatus as recited in claim 1, wherein said quench feeder comprises said fine spraying nozzle for injecting said evaporating liquid into said reaction chamber.

9. An apparatus as recited in claim 1, wherein said reaction chamber is generally cylindrical and has opposite top and bottom longitudinal end apertures;

said plasma torch being mounted on top of said reaction chamber through said top end aperture.

10. An apparatus as recited in claim 9, further comprising a first collector mounted to said reaction chamber through said bottom end aperture.

11. An apparatus as recited in claim 10, wherein said first collector is mounted to said reaction chamber via a funnel.

12. An apparatus as recited in claim 11, further comprising a receptacle connected to said funnel so as to be in fluid communication therewith.

13. An apparatus as recited in claim 12, wherein said receptacle is configured and mounted to said reaction chamber for collecting rhenium powder by gravity.

14. An apparatus as recited in claim 12, further comprising a vacuum system mounted to said receptacle so as to be located downstream thereof in fluid communication therewith for forcing rhenium powder in said receptacle.

15. An apparatus as recited in claim 12, further comprising a cyclone collector having an inlet connected to said receptacle via a conduit so as to be in fluid communication therewith and so as to be located downstream therefrom.

16. An apparatus as recited in claim 15, wherein said cyclone collector is provided with an outlet; and further comprising a filter collector having an inlet connected to said outlet of said cyclone collector.

17. An apparatus as recited in claim 1, wherein said plasma chamber of said plasma torch is generally cylindrical.

18. An apparatus as recited in claim 1, wherein said plasma torch further includes at least one input aperture for feeding said plasma chamber with a sheath gas and a central gas.

19. An apparatus as recited in claim 18, wherein said at least one input aperture includes a first aperture for feeding said plasma chamber with said sheath gas and a second aperture for feeding said plasma chamber with said central gas.

* * * * *